US005499818A

United States Patent [19]

Allal

[11] Patent Number: 5,499,818

[45] Date of Patent: Mar. 19, 1996

[54] MYSTICAL ASTROLOGICAL PREDICTIVE-TYPE BOARD GAME

[76] Inventor: Al M. Allal, P.O. Box 155, Rosser, Tex. 75157

[21] Appl. No.: 383,598

[22] Filed: Feb. 3, 1995

[51] Int. Cl.[6] ..... A63F 3/02

[52] U.S. Cl. ..... 273/161; 273/284

[58] Field of Search ..... 273/161, 237, 273/243, 247, 256, 283, 284, 429, 303, 304

[56] References Cited

U.S. PATENT DOCUMENTS

| | | | |
|---|---|---|---|
| 1,370,249 | 3/1921 | White | 273/161 |
| 2,034,991 | 3/1936 | Salinger | 273/161 |
| 3,652,092 | 3/1972 | Boyer et al. | 273/243 |
| 3,785,654 | 1/1974 | Chambers | 273/249 |
| 4,359,226 | 11/1982 | Neff | 273/243 |
| 5,039,107 | 8/1991 | Jackson | 273/247 |

*Primary Examiner*—V. Miller
*Assistant Examiner*—Steven B. Wong

[57] ABSTRACT

A mystical astrological predictive-type board game including a deck of teliotarotarcane cards including a first sub-deck of minor tarot cards, a second sub-deck of minor shustah cards, a third sub-deck of major tarot cards, a fourth sub-deck of premium cards, and a fifth sub-deck of maximum mystique cards and with each card having a point value; and a game board bearing indicia of a cross, a star with a first rectangle therearound, a second rectangle with a distinctive word thereon, a circle with a distinctive symbol thereon, an ankh, an encircled eye, an encircled triangle, an encircled star, and an answer area formed of an upper circle with an affirmative symbol disposed thereon, a lower circle with a negative symbol disposed thereon, and a segment interconnecting the upper circle with the lower circle; and a rule book providing the rules of play.

6 Claims, 4 Drawing Sheets

MYSTICAL ASTROLOGICAL PREDICTIVE-TYPE BOARD GAME

BACKGROUND OF THE INVENTION

1. Field of the Invention

The present invention relates to a mystical astrological predictive-type board game and more particularly pertains to formulating predictions about significant and meaningful events in life based on questions posed by players with a mystical astrological predictive-type board game.

2. Description of the Prior Art

The use of board games is known in the prior art. More specifically, board games heretofore devised and utilized for the purpose of making predictive assessments for players are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 255,699 to Myers discloses an astrological game board. U.S. Pat. No. Des. 258,392 to Reebemacker discloses an astrology game board. U.S. Pat. No. 3,652,092 to Boyer et al. discloses an astrology board game apparatus. U.S. Pat. No. 3,785,654 to Chambers discloses an astrological board game apparatus. U.S. Pat. No. 5,064,201 to Smith discloses a method of playing a board game.

While these devices fulfill their respective, particular objective and requirements, the aforementioned patents do not describe a mystical astrological predictive-type board game that allows players to receive predictive assessments to questions posed during play using a special deck of cards.

In this respect, the mystical astrological predictive-type board game according to the present invention substantially departs from the conventional concepts and designs of the prior art, and in doing so provides an apparatus primarily developed for the purpose of formulating predictions about significant and meaningful events in life based on questions posed by players.

Therefore, it can be appreciated that there exists a continuing need for new and improved mystical astrological predictive-type board game which can be used for formulating predictions about significant and meaningful events in life based on questions posed by players. In this regard, the present invention substantially fulfills this need.

SUMMARY OF THE INVENTION

In the view of the foregoing disadvantages inherent in the known types of board games now present in the prior art, the present invention provides an improved mystical astrological predictive-type board game. As such, the general purpose of the present invention, which will be described subsequently in greater detail, is to provide a new and improved mystical astrological predictive-type board game and method which has all the advantages of the prior art and none of the disadvantages.

To attain this, the present invention essentially comprises, in combination, a deck of 108 teliotarotarcane cards. The deck of teliotarotarcane cards includes a first sub-deck of 48 minor tarot cards, a second sub-deck of 14 minor shustah cards, a third sub-deck of 22 major tarot cards, a fourth sub-deck of 12 premium cards, and a fifth sub-deck of 12 maximum mystique cards. The first sub-deck of minor tarot cards includes a first suit of 12 spades, a second suit of 12 clubs, a third suit of 12 hearts, and a fourth suit of 12 diamonds. Each suit includes a first set of 8 cards bearing numbers thereon from 2 to 9, respectively, and a second set of 4 cards bearing a symbol of a jack, a queen, a king, and an ace thereon, respectively. Each card of the first set has a point value equal to its respective number. The jack, the queen, and the king have a point value of 11. The ace has a point value of 1 or 10 based upon a player's discretion.

The second sub-deck of minor shustah cards includes a first set of 10 cards bearing numbers thereon from 1 to 10, respectively, and a second set of 4 cards bearing a knight, a leader, a prince, and a princess thereon, respectively. Each card of the first set has a point value equal to its respective number. The cards of the second set each have a point value of 11.

The third sub-deck of major tarot cards includes 22 cards bearing numbers thereon from 0 to 21, respectively. The cards further bear mystic symbols thereon. Specifically, the cards bear a joker, a magician, an empress, an emperor, a priestess, a priest, a symbol for lovers, a chariot, a depiction of justice, a hermit, a wheel-of-fortune, a depiction of strength, a hanged man, a depiction of death, a depiction of temperance, a devil, a tower, a star, a moon, a sun, a depiction of judgement, and a depiction of the world, respectively. The symbol for lovers can be realized as a pair of lovers or a heart pierced by an arrow, for example. Each card has a point value equal to its respective number.

The fourth sub-deck of premium cards includes 12 cards bearing numbers thereon from 0 to 12, respectively. The cards further bear zodiac symbols thereon including capricorn, aquarius, pisces, aries, taurus, gemini, cancer, leo, virgo, libra, scorpio, and sagittarius, respectively. Each card has a point value equal to its respective number.

The fifth sub-deck of maximum mystique cards includes 12 cards bearing numbers thereon from 0 to 11, respectively. The cards further bear elemental symbols thereon. The cards numbered "0" and "10" each bear an elemental symbol of metal. The cards numbered "1" and "11" each bear an elemental symbol of air. The cards numbered "2" and "3" each bear an elemental symbol of water. The cards numbered "4" and "5" each bear an elemental symbol of wood. The cards numbered "6" and "7" each bear an elemental symbol of fire. The cards numbered "8" and "9" each bear an elemental symbol of earth.

A rectangular planar game board is provided. The game board has an upper surface, a lower surface, an upper left corner, a lower left corner, an upper right corner, a lower right corner, a periphery formed of a top edge, a bottom edge, a left edge, and a right edge, and an enclosed central portion. The upper surface of the game board bears indicia of a cross located adjacent to the left edge and with the cross having an upper end adjacent to the upper left corner and a lower end located adjacent to the lower left corner, a star with a first rectangle therearound located near the upper right corner, a second rectangle with the word "KEEP" thereon located near the lower right corner, a circle with the symbol "XOAB" thereon located between the first rectangle and the second rectangle and adjacent to the right edge, an ankh located on the central portion and aligned in parallel with the cross and with the ankh having an upper end located adjacent to the upper edge and a lower end located adjacent to the lower edge, an encircled eye located between the upper ends of the cross and ankh and with the encircled eye further bearing indicia of "12", "3", "6" and "9" therearound and with the number "12" located above the eye, the number "6" located below the eye, the number "9" located to the left of the eye, and the number "3" located to the right of the eye, an encircled triangle located between the lower ends of the cross and ankh, an encircled star located between the encircled eye and the encircled triangle, and an answer area formed of an upper circle with the symbol "YES" disposed thereon, a lower circle with the symbol "NO" disposed thereon, and a segment interconnecting the upper circle with the lower circle and with the answer area located between the ankh and the circle with the symbol "XOAB" thereon.

A calculator is provided for tallying score values. A plurality of score sheets are provided for maintaining a status of score values during play. Lastly, a rule book is included and provides the rules of play.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mystical astrological predictive-type board game which has all the advantages of the prior art board games and none of the disadvantages.

It is another object of the present invention to provide a new and improved mystical astrological predictive-type board game which may be easily and efficiently manufactured and marketed.

It is a further object of the present invention to provide a new and improved mystical astrological predictive-type board game which is of durable and reliable construction.

An even further object of the present invention is to provide a new and improved mystical astrological predictive-type board game which is susceptible of a low cost of manufacture with regard to both materials and labor, and which accordingly is then susceptible of low prices of sale to the consuming public, thereby making such a mystical astrological predictive-type board game economically available to the buying public.

Still yet another object of the present invention is to provide a new and improved mystical astrological predictive-type board game which provides in the apparatuses and methods of the prior art some of the advantages thereof, while simultaneously overcoming some of the disadvantages normally associated therewith.

Even still another object of the present invention is to provide a new and improved mystical astrological predictive-type board game for formulating predictions about significant and meaningful events in life based on questions posed by players.

Lastly, it is an object of the present invention to provide a new and improved mystical astrological predictive-type board game comprising a deck of teliotarotarcane cards including a first sub-deck of minor tarot cards, a second sub-deck of minor shustah cards, a third sub-deck of major tarot cards, a fourth sub-deck of premium cards, and a fifth sub-deck of maximum mystique cards and with each card having a point value; and a game board bearing indicia of a cross, a star with a first rectangle therearound, a second rectangle with a distinctive word disposed thereon, a circle with a distinctive symbol disposed thereon, an ankh, an encircled eye, an encircled triangle, an encircled star, and an answer area formed of an upper circle with an affirmative symbol disposed thereon, a lower circle with a negative symbol disposed thereon, and a segment interconnecting the upper circle with the lower circle; and a rule book providing the rules of play.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 2:
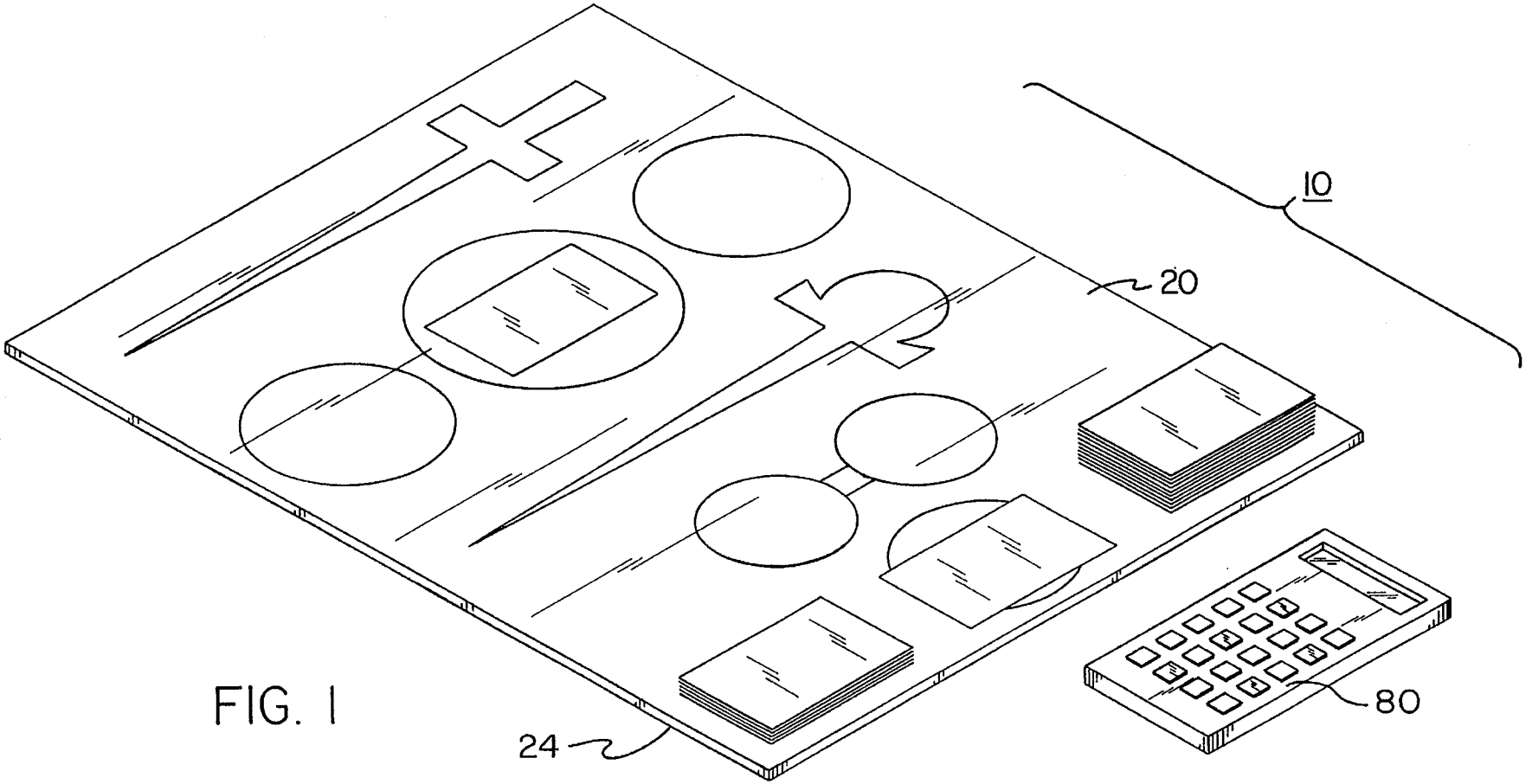
FIG. 1 is a perspective view of the game board with the deck of teliotarotarcane cards in operation thereon.
FIG. 2 is a perspective view of the calculator of the present invention for tallying scores obtained through use of the teliotarotarcane cards on the game board.
Figure 3:
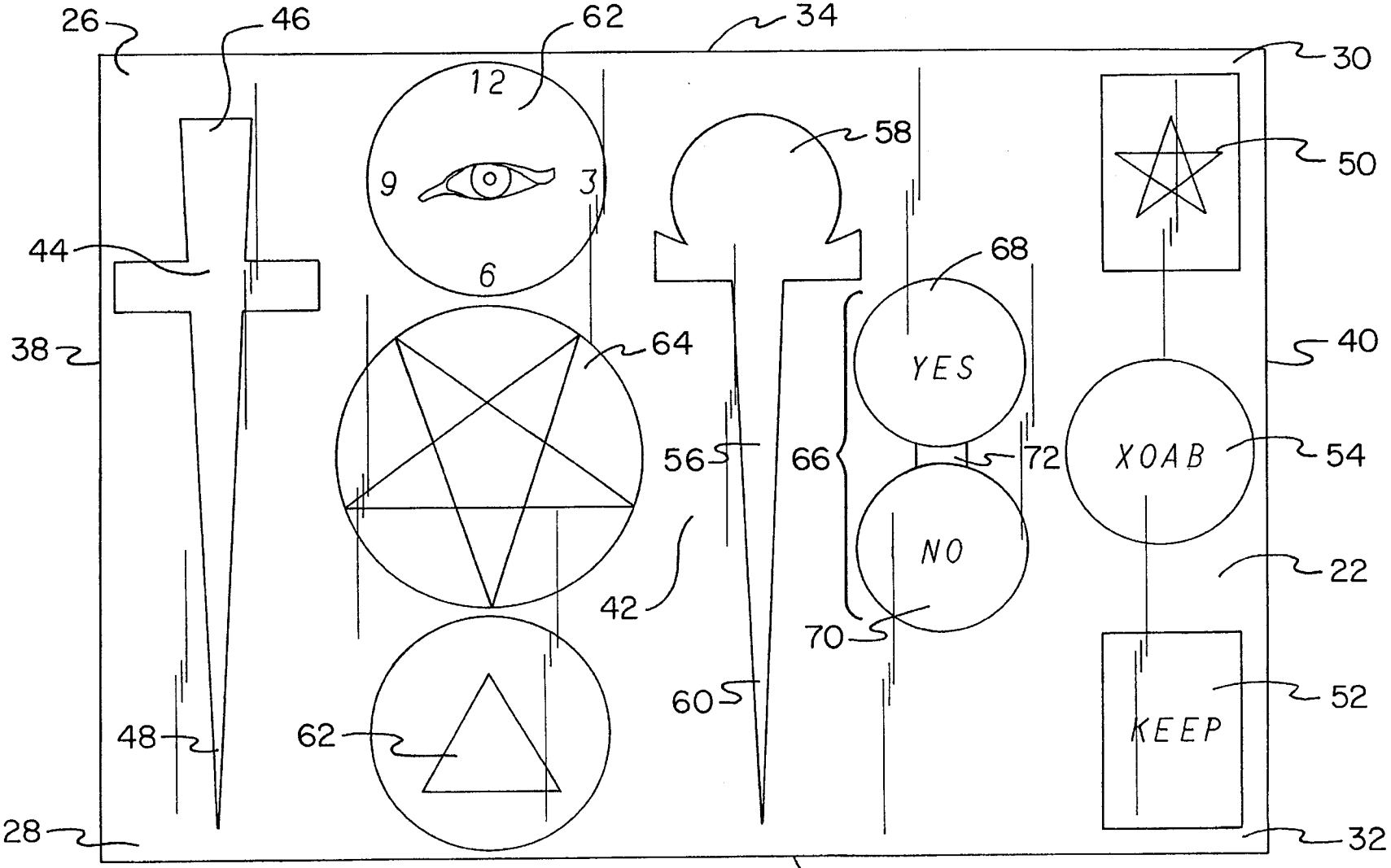
FIG. 3 is a plan view of the game board of the present invention.
Figure 4:
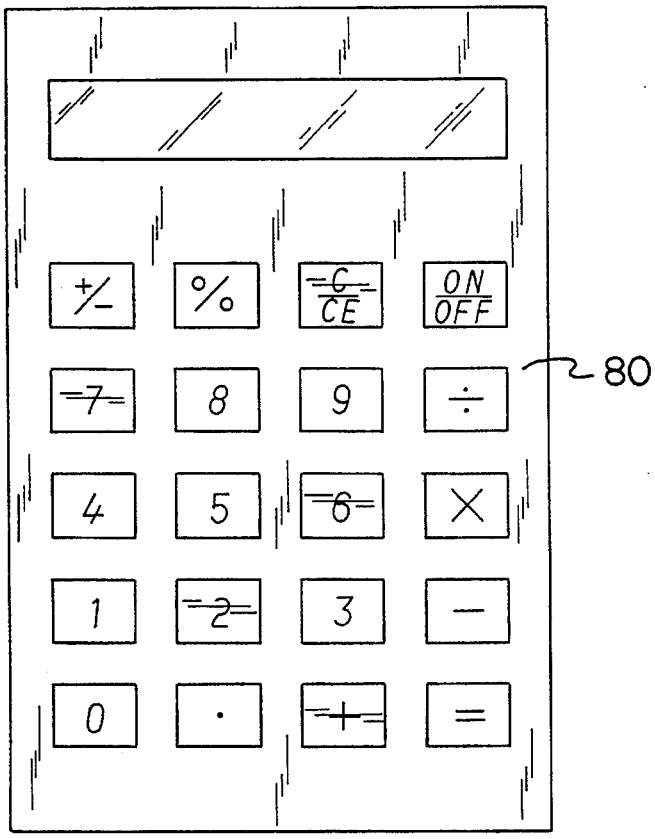
FIG. 4 is a plan view of the calculator of the present invention.
Figure 5:
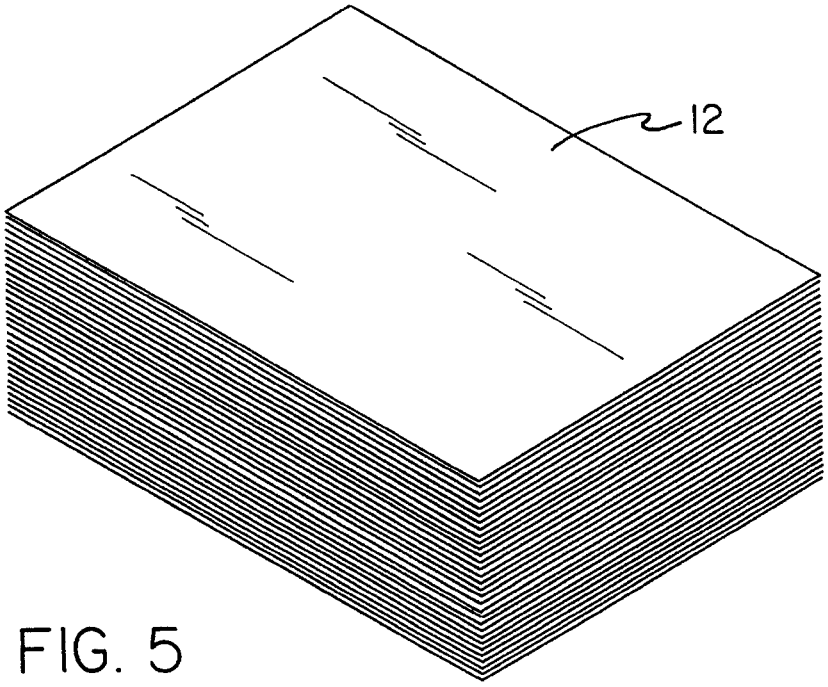
FIG. 5 is a perspective view of the deck of teliotarotarcane cards of the present invention.
Figure 6:
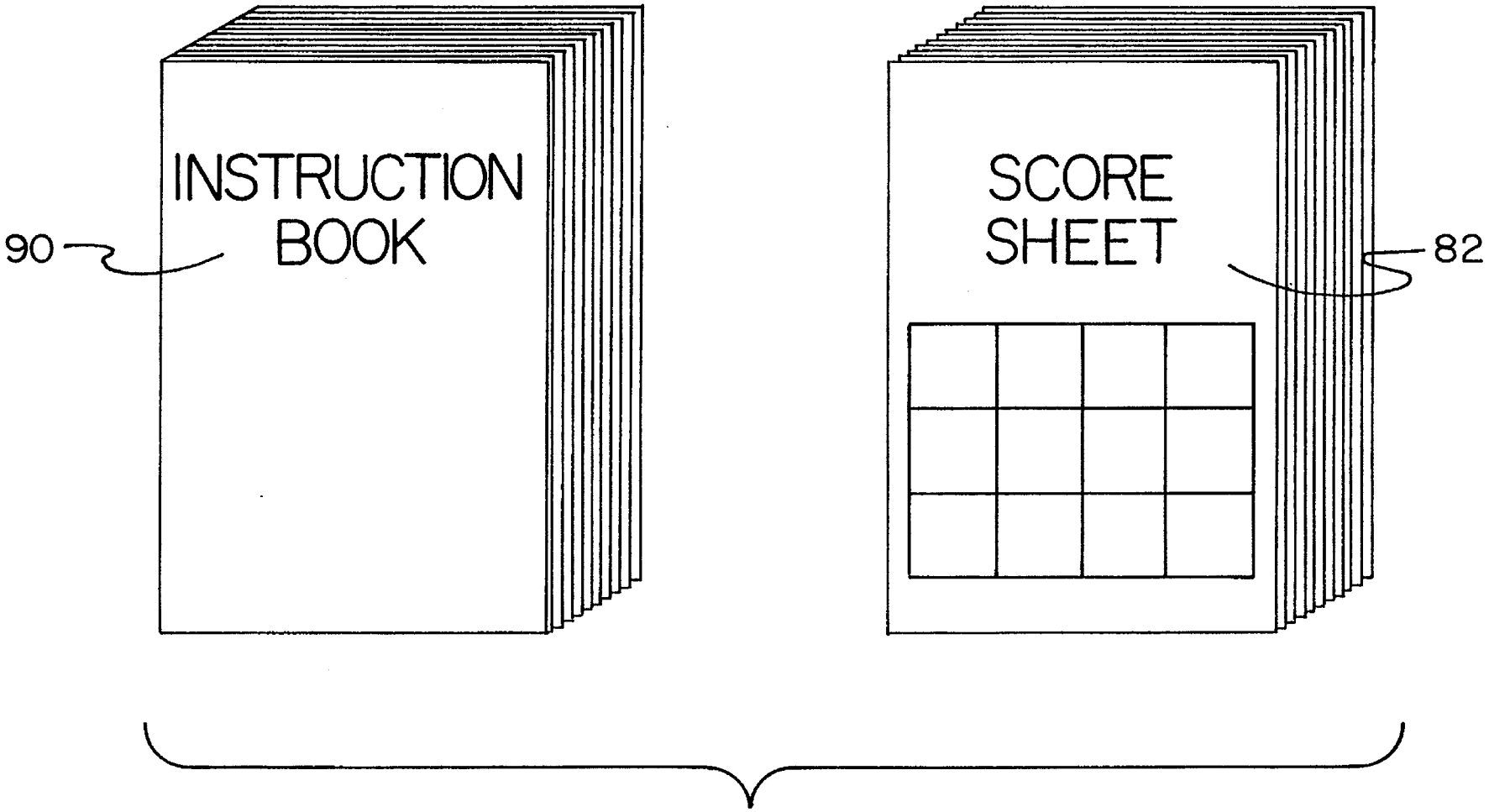
FIG. 6 is a perspective view of a score sheet of the present invention.

With reference now to the drawings, and in particular, to FIG. 1 thereof, the preferred embodiment of the new and improved mystical astrological predictive-type board game embodying the principles and concepts of the present invention and generally designated by the reference number 10 will be described.

The present invention is comprised of a plurality of components. In their broadest context, such components include a game board, teliotarotarcane cards, and a rule book. Such components are individually configured and correlated with respect to each other to provide the intended function of formulating predictions about significant and meaningful events in life based upon questions posed by players during play.

Specifically, the present invention includes a deck 12 of one-hundred eight teliotarotarcane cards. Each card of the deck has a face and a back. Indicative indicia representing numbers or symbols or a combination thereof are disposed on the face of a card. The back of the cards either is left blank or bears a distinctive design. The deck of teliotarotarcane cards includes a first sub-deck of minor tarot cards, a second sub-deck of minor shustah cards, a third sub-deck of major tarot cards, a fourth sub-deck of premium cards, and a fifth sub-deck of maximum mystique cards. The following tables describes the cards of each sub-deck in detail:

TABLE 1

| Minor Tarot Card Sub-deck | | | | | |
|---|---|---|---|---|---|
| Sub-deck | Number of cards | Suit of card | Number on card | Symbol on card | Point value of card |
| minor tarot | 48 | spades, clubs, hearts, diamonds- 12 cards per suit | 2 | same as the suit of card | same as number on card |
| | | | 3 | | |
| | | | 4 | | |
| | | | 5 | | |
| | | | 5 | | |
| | | | 6 | | |
| | | | 7 | | |
| | | | 8 | | |
| | | | 9 | | |
| | | | jack | | 11 |
| | | | queen | | 11 |
| | | | king | | 11 |
| | | | ace | | 1 or 10 |

TABLE 2

| Minor Shustah Card Sub-deck | | | | |
|---|---|---|---|---|
| Sub-deck | Number of cards | Number on card | Symbol on card | Point value of card |
| minor shustah | 14 | 1 | same as number on | same as number on card |
| | | 2 | | |
| | | 3 | | |
| | | 4 | | |
| | | 5 | | |
| | | 6 | | |
| | | 7 | | |
| | | 8 | | |
| | | 9 | | |
| | | 10 | | |
| | | | knight | 11 |
| | | | leader | 11 |
| | | | prince | 11 |
| | | | princess | 11 |

TABLE 3

| Major Taro Sub-deck | | | | |
|---|---|---|---|---|
| sub-deck | Number of cards | Number on card | Symbol on card | Point value of card |
| major taro cards | 22 | 0 | joker | same as number on card |
| | | 1 | magician | |
| | | 2 | empress | |
| | | 3 | emperor | |
| | | 4 | priestess | |
| | | 5 | priest | |
| | | 6 | lovers | |
| | | 7 | chariot | |
| | | 8 | justice | |
| | | 9 | hermit | |
| | | 10 | wheel of fortune | |
| major taro cards | see previous page | 11 | strength | same as number on card |
| | | 12 | hanged man | |
| | | 13 | death | |
| | | 14 | temperance | |
| | | 15 | devil | |
| | | 16 | tower | |
| | | 17 | star | |
| | | 18 | moon | |
| | | 19 | sun | |
| | | 20 | judgement | |
| | | 21 | world | |

TABLE 4

| Premium Card Sub-deck | | | | |
|---|---|---|---|---|
| Sub-deck | Number of cards | Number on card | Zodiac Symbol on card | Point value of card |
| premium cards | 12 | 1 | capricorn | same as number |
| | | 2 | aquarium | |
| | | 3 | pisces | |
| | | 4 | aries | |
| | | 5 | taurus | |
| | | 6 | gemini | |
| | | 7 | cancer | |
| | | 8 | leo | |
| | | 9 | virgo | |
| | | 10 | libra | |
| | | 11 | scorpio | |
| | | 12 | sagittarius | |

TABLE 5

| Maximum Mystique Card Sub-deck | | | | |
|---|---|---|---|---|
| Sub-deck | Number of cards | Number on card | Symbol on card | Point value of card |
| maximum mystique cards | 12 | 0 | metal | same as |
| | 1 | air | number | |
| | | 2 | water | |
| | | 3 | water | |
| | | 4 | wood | |
| | | 5 | wood | |
| | | 6 | fire | |
| | | 7 | fire | |
| | | 8 | earth | |
| | | 9 | earth | |
| | | 10 | metal | |
| | | 11 | air | |

A game board 20 is also provided. The game board is rectangular in structure. The game board has an upper surface 22 and a lower surface 24. The upper surface has an upper left corner 26, a lower left corner 28, an upper right corner 30, and a lower right corner 32. A periphery interconnects the upper surface with the lower surface. The periphery is formed of a top edge 34, a bottom edge 36, a left edge 38 and a right edge 40. The periphery of the board encloses a central portion 42. The upper surface of the game board bears indicia. A cross 44 is located adjacent to the left edge of the game board. The cross has an upper end 46 located adjacent to the upper left corner and a lower end 48 located adjacent to the lower left corner. The game board also includes a holding area 50 for the cards. This holding area is formed of a star with a first rectangle therearound. The holding area is located near the upper right corner. The game board also includes a discard area 52. The discard area is formed of a second rectangle with the work "KEEP" thereon. The discard area is located near the lower right corner. The discard area is used for holding expended cards not in play. The game board also includes a preselected card holding area 54. This preselected card holding area is formed of a circle with a symbol "XOAB" thereon. This preselected card holding area is located between the card holding area and the discard holding area. Also included is an ankh 56 located on the central portion. The ankh is aligned in parallel with the cross. The ankh has an upper end 58 located adjacent to the upper edge and a lower end 60 located adjacent to the lower edge. An encircled eye 62 is located between the upper ends of the cross and ankh. The encircled eye further bears indicia of "12", "3", "6" and "9" therearound. The number "12" is located above the eye. The number "6" is located below the eye. The number "9" is located to the left of the eye. The number "3" is located to the right of the eye. Also included is an encircled triangle 62. The encircled triangle is located between the lower ends of the cross and ankh. Also provided is an encircled star 64. This encircled star is located between the encircled eye and the encircled triangle. An answer area 66 is provided. The answer area is formed of an upper circle 68 with the symbol "YES" disposed thereon, a lower circle 70 with the symbol "NO" disposed thereon, and a segment 72 interconnecting the upper circle with the lower circle. The answer area is located between the ankh and the circle with the symbol "XOAB" thereon.

A calculator 80 is provided for tallying score values during play. A plurality of scoring sheets 82 are also provided. The scoring sheets are used for maintaining a status of score values during play. Lastly, a rule book 90 is included. The rule book sets forth the rules of play. The rule book of the present invention is set forth as follows:

RULE BOOK

The board game can be played with from 1 to 12 players, with the limit of 12 players being set by the amount of zodiac signs available for use.

Step 1. Place a card drawn from the premium card sub-deck on the "XOAB" section (preselected card holding area) of the game board. This card is designated as the first preselected card. The first preselected card is chosen based on a player's birth date. For example, if a player birth date is 22 Jan 1962, the card which would be laid down on the "XOAB" symbol would be "aquarius".

Step 2. Place a card drawn from the maximum mystique card sub-deck on the encircled star of the game board. This card is designated as the second preselected card. The second preselected card is chosen using the last digit of the year of birth of a player. For example, if a player was born on 22 Jan 1962, the player would select the maximum mystique card numbered "2". The remaining cards of the teliotarotarcane deck are now shuffled and placed "face down" on the star section (holding area) in the upper right corner of the game board.

Step 3. Establish a channel. A channel places a player "in communication" with the game board. Draw a card from the teliotarotarcane deck and place on the encircled eye of the game board. The value of the card establishes the channel type as follows:

TABLE 6

| Channel Type | | |
|---|---|---|
| Score Value of Card of teliotarotarcane deck placed on eye section | Channel Name | Type of Channel |
| 0 | no channel | indefinite |
| 1 | singular | one way |
| 2 | binary | two way |
| 3 | trinity | party line |
| 4 | doubles | public |
| 5 | cardinal | multi-signal |
| 6 | external | on-line |
| 7 | receptional | reckon |
| 8 | pulsational | beacon |
| 9 | maximass | autonomous |
| 10 | privation | court |
| 11 | queens | rumor |
| 12 | kings | top priority |
| 13 | dual or polarity | pre-channel |

Step 4. Formulate a question to be asked. Each question to be asked is formulated such that it can be answered in the affirmative, the negative, or neutral. When playing in a group, these questions are shared with the other players. Draw next card from the teliotarotarcane deck and place on the encircled triangle to establish a dialogue of casting. The dialogue essentially enables or activates the channel for use. The dialogue is established by disposing cards on either the cross or the ankh or both the cross and ankh of the game board. The following table is used to determine how many cards may be placed on the cross and ankh subject to the following constraints:

1. Only 3 cards at most may be placed on the cross or the ankh.
2. At least 1 card must be placed on either the cross or the ankh.

TABLE 7

| Dialogue Establishment | |
|---|---|
| Card placed on encircled triangle section | Number of Cards that may be placed on the cross or ankh to establish a dialogue |
| minor tarot cards: 2–9 of each suit (total 8 × 4 = 32 cards) | 1 |
| minor tarot cards: jack, queen, king, and ace of each suit (total 16 cards) | 2 |
| all minor shustah cards (total 14 cards) | 3 |
| all premium cards: 1–12 (total 12 cards) | 4 |
| all maximum mystique cards: 1–10 (total 12 cards) | 5 |
| all major tarot cards: 0–21 (total 22 cards) | 6 |

Step 5. Place next card from deck of teliotarotarcane cards on the "Yes/No" section. The "Yes/No" section is used to check if the dialogue in Step 4 is approved for use. Use the following table to determine if the dialogue is approved. Tally the number of answers based upon the cards on the cross, ankh, and "Yes/No" section. The answers obtained also represent a composite answer to a player's question.

TABLE 8

| Sub-deck cards | Answer to Question Posed by Player: Yes | No | Maybe | Not available (no answer is given with respect to use of dialogue) |
|---|---|---|---|---|
| minor tarot | ace, 2, 3 | 4–6 | 7–9 | jack, queen, king |
| minor shustah | 1–4 | 5–8 | 9, 10, leader, princess | knight, prince |
| major tarot | 0–10 | 5–10 | 11–15 | 16–21 |
| premium | 1–3 | 4–6 | 7–9 | 10–12 |
| maximum mystique | 0, 6, 9 | 1, 3, 10 | 2, 5, 7 | 4, 8, 11 |

If answer is "No" or "Not available" then pick up the cards on cross and ankh and the encircled triangle section and place on the "KEEP" section. The preselected cards remain in place. Go to step 4. Note that when a player performs Step 1 through Step 5, this player has performed a "cast". Cards used in a cast are designated as "cast cards". Cast cards do not include the preselected cards. Continue casting until approval of dialogue is provided (i.e., a "Yes" or "Maybe" answer is provided). Step 6. Once approval is given of the dialogue, the total of the score values of the cards on the cross, ankh, and encircled triangle provide a "context of view" for the answer provided in Step 5. To determine this "context of view", use the following equation to determine the score value. Use the calculator provided.

total=sum of card score values placed on the cross+ sum of card score values placed on the ankh+ score value of card placed on the encircled triangle score value=total mod 10+total rem 10 where:

mod is the modulus of the total and rem is the remainder of the total

Example: where total=45, score value=45 mod 10+45 rem 10=4+5=9

This score value is easily obtained through the use of the calculator by adding successive digits of the total. Now, since the point value has been found, determine the context in which the answer to a question is to be evaluated.

TABLE 9

| point value | context | Context to Evaluate Answer to Question: Numerology associated symbology for analysis |
|---|---|---|
| 0 | non-applicable | non-applicable |
| 1 | creation | A, B |
| 2 | duality | C, D, E |
| 3 | complete | F, G, H |
| 4 | foundation | I, J, K |
| 5 | cardinal | L, M, N |
| 6 | wholeness | O, P, Q |
| 7 | unique | R, S, T |

TABLE 9-continued

| point value | context | Context to Evaluate Answer to Question: Numerology associated symbology for analysis |
|---|---|---|
| 8 | fullness | U, V, W |
| 9 | spiritual | X, Y, Z |

The associated symbology can be used to spell words (through several casts) related to the question or questions set forth by a player. For example if the answer to a question is "Yes" and the point value is "9", this answer is to be viewed in a spiritual context. Alternatively, the letters "X, Y, Z" are obtained. These letters may be used in associated with successive casts performed one after another to see if a word is spelled. Therefore, the present invention operates in a manner much like a ouija board.

Now, in order to receive an answer to another question posed, pick up cards on cross and ankh and the encircled triangle section and place them on the "KEEP" section; go to step 4. Alternatively, when playing in a group, play is passed to the next player, who then starts at Step 1.

The board game can be played with scoring or no scoring. If scoring is used, each player casts cards on the board in turn using the steps provided above to obtain a score value. The first player to attain a score value of 250 points wins. A player can also keep track of the answers obtained from a cast. A sample sheet from a score pad is provided below:

TABLE 10

| Answer | Blank Score Sheet: Number of Answers from cards used to establish dialogue | Score value from cast |
|---|---|---|
| Yes | | |
| No | | |
| Maybe | | |
| Not Available | | |
| Date: | | |

An example score sheet is provided below:

TABLE 11

| Answer | Example Score Sheet: Number of cards used in cast | Number of Answers |
|---|---|---|
| Yes | 7 | 3 |
| No | 10 | 4 |
| Maybe | 2 | 1 |
| Not Available | 5 | 2 |
| Date: 6 Oct 94 | | |

In this example, 3 "Yes" were obtained from a cast of 7 cards, 4 "No" were obtained from a cast of 10 cards, and 2 "Not Available" were obtained on a cast of 2 cards.

In the preferred embodiment, the game board is about 24 inches wide and is about 16 inches up to about 24 inches in length. The game board is formed of cloth, wood, plastic, or laminated base board or cardboard. The circles and the rectangles on the game board are of a size large enough to encompass the cards when placed thereon. The background of the game board may be colored black, blue, red or white.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A mystical astrological predictive-type board game for formulating predictions about significant and meaningful events in life based on questions posed by players comprising, in combination:

a deck of 108 teliotarotarcane cards, the deck of teliotarotarcane cards including a first sub-deck of 48 minor tarot cards, a second sub-deck of 14 minor shustah cards, a third sub-deck of 22 major tarot cards, a fourth sub-deck of 12 premium cards, and a fifth sub-deck of 12 maximum mystique cards, the first sub-deck of minor tarot cards further including a first suit of 12 spades, a second suit of 12 clubs, a third suit of 12 hearts, and a fourth suit of 12 diamonds, each suit including a first set of 8 cards bearing numbers thereon from 2 to 9, respectively, and further including a second set of 4 cards bearing a symbol of a jack, a queen, a king, and an ace thereon, respectively, each card of the first set having a point value equal to its respective number, the jack, the queen, and the king having a point value of 11 and with the ace having a point value of 1 or 10 based upon a player's discretion;

the second sub-deck of minor shustah cards further including a first set of 10 cards bearing numbers thereon from 1 to 10, respectively, and a second set of 4 cards bearing a knight, a leader, a prince, and a princess thereon, respectively, each card of the first set having a point value equal to its respective number, the cards of the second set each having a point value of 11;

the third sub-deck of major tarot cards further including 22 cards bearing numbers thereon from 0 to 21, respectively, the cards further bearing a mystic symbol thereon of a joker, a magician, an empress, an emperor, a priestess, a priest, a symbol for or a pair of lovers, a chariot, a depiction of justice, a hermit, a wheel-of-fortune, a depiction of strength, a hanged man, a depiction of death, a depiction of temperance, a devil, a tower, a star, a moon, a sun, a depiction of judgement, and a depiction of the world, respectively, each card having a point value equal to its respective number, the fourth sub-deck of premium cards further including 12 cards bearing numbers thereon from 0 to 12, respectively, the cards further bearing a zodiac symbol thereon including capricorn, aquarius, pisces, aries, taurus, gemini, cancer, leo, virgo, libra, scorpio, and sagittarius, respectively, each card having a point value equal to its respective number, and the fifth sub-deck of maximum mystique cards further including 12 cards bearing numbers thereon from 0 to 11, respectively, the cards further bearing elemental symbols thereon with the cards numbered 0 and 10 each further bearing an elemental symbol of metal, the cards numbered "1" and "11" each further bearing an elemental symbol of air, the cards numbered "2" and "3" each further bearing an elemental symbol of water, the cards numbered "4" and "5" each further bearing an elemental symbol of wood, the cards numbered "6" and "7" each further bearing an elemental symbol of fire, and the cards numbered "8" and "9" further bearing an elemental symbol of earth;

a rectangular planar game board having an upper surface, a lower surface, an upper left corner, a lower left corner, an upper right corner, a lower right corner, a periphery formed of a top edge, a bottom edge, a left edge, and a right edge, and an enclosed central portion, the upper surface of the game board bearing indicia of a cross located adjacent to the left edge and with the cross having an upper end adjacent to the upper left corner and a lower end located adjacent to lower left corner, a star with a first rectangle therearound located near the upper right corner, a second rectangle with the word "KEEP" thereon located near the lower right corner, a circle with the symbol "XOAB" thereon located between the first rectangle and second rectangle and adjacent to the right edge, an ankh located on the central portion and aligned in parallel with the cross and with the ankh having an upper end located adjacent to the upper edge and a lower end located adjacent to the lower edge, an encircled eye located between the upper ends of the cross and ankh and with the encircled eye further bearing indicia of "12", "3", "6" and "9" therearound and with the number "12" located above the eye, the number "6" located below the eye, the number "9" located to the left of the eye, and the number "3" located to the right of the eye, an encircled triangle located between the lower ends of the cross and ankh, an encircled star located between the encircled eye and the encircled triangle, and an answer area formed of an upper circle with the symbol "YES" disposed thereon, a lower circle with the symbol "NO" disposed thereon, and a segment interconnecting the upper circle with the lower circle located between the ankh and the circle with the symbol "XOAB" thereon;

a calculator for tallying score values;

and a plurality of score sheets for maintaining a status of score values during play; and a rule book providing the rules of play.

2. A mystical astrological predictive game comprising:

a deck of teliotarotarcane cards including a first sub-deck of minor tarot cards, a second sub-deck of minor shustah cards, a third sub-deck of major tarot cards, a fourth sub-deck of premium cards, and a fifth sub-deck of maximum mystique cards and with each card having a point value;

the first sub-deck of minor tarot cards including a first suit of 12 spades, a second suit of 12 clubs, a third suit of 12 hearts, and a fourth suit of 12 diamonds, each suit including a first set of 8 cards bearing numbers thereon from 2 to 9, respectively, and further including a second set of 4 cards bearing a symbol of a jack, a queen, a king, and an ace thereon, respectively, each card of the first set having a point value equal to its respective number, the jack, the queen, and the king having a point value of 11 and with the ace having a point value of 1 or 10 based upon the player's discretion;

a game board bearing indicia of a cross, a star with a first rectangle therearound, a second rectangle with a distinctive word disposed thereon, a circle with a distinctive symbol disposes thereon, an ankh, an encircled eye, an encircled triable, and encircled star, and an answer area formed of an upper circle with an affirmative symbol disposed thereon, a lower circle with a negative symbol disposed thereon, and a segment interconnecting the upper circle with the lower circle; and a rule book providing the rules of play.

3. The mystical astrological predictive-type board game as set forth in claim 2 wherein the second sub-deck of minor shustah cards includes a first set of 10 cards bearing numbers thereon from 1 to 10, respectively, and a second set of 4 cards bearing a knight, a leader, a prince, and a princess thereon, respectively, each card of the first set having a point value equal to its respective number, the cards of the second set each having a point value of 11.

4. The mystical astrological predictive-type board game as set forth in claim 2 wherein the third sub-deck of major tarot cards includes 22 cards bearing numbers thereon from 0 to 21, respectively, the cards further bearing a mystic symbol thereon of a joker, a magician, an empress, an emperor, a priestess, a priest, a symbol or pair of lovers, a chariot, a depiction of justice, a hermit, a wheel-of-fortune, a depiction of strength, a hanged man, a depiction of death, a depiction of temperance, a devil, a tower, a star, a moon, a sun, a depiction of judgement, and a depiction of the world, each card having a point value equal to its respective number.

5. The mystical astrological predictive-type board game as set forth in claim 2 wherein the fourth sub-deck of premium cards includes 12 cards bearing numbers thereon from 0 to 12, respectively, the cards further bearing a zodiac symbol thereon including capricorn, aquarius, pisces, aries, taurus, gemini, cancer, leo, virgo, libra, scorpio, and sagittarius, each card having a point value equal to its respective number.

6. The mystical astrological predictive-type board game as set forth in claim 2 wherein the fifth sub-deck of maximum mystique cards includes 12 cards bearing numbers thereon from 0 to 11, respectively, the cards further bearing elemental symbols thereon with two of the cards bearing an elemental symbol of metal, two of the cards bearing an elemental symbol of air, two of the cards bearing an elemental symbol of water, two of the cards bearing an elemental symbol of wood, two of the cards bearing an elemental symbol of fire, and the remaining two cards bearing an elemental symbol of earth.

* * * * *